United States Patent [19]

Pride

[11] Patent Number: 5,050,251

[45] Date of Patent: Sep. 24, 1991

[54] APPARATUS FOR CONVERTING A BATHTUB INTO A SAUNA

[76] Inventor: John T. Pride, 1735 104th Ave., Oakland, Calif. 94603

[21] Appl. No.: 604,102

[22] Filed: Oct. 29, 1990

[51] Int. Cl.[5] ..... A61H 33/00; A61H 33/06

[52] U.S. Cl. ..... 4/534; 4/526; 128/367

[58] Field of Search ..... 4/534, 533, 526, 527, 4/530; 128/371, 374, 369, 367

[56] References Cited

U.S. PATENT DOCUMENTS

| | | | |
|---|---|---|---|
| 558,857 | 4/1896 | Sternkopf | 4/527 |
| 945,241 | 1/1910 | Mayer | 4/534 |
| 959,743 | 5/1910 | Hoyt | 128/367 |
| 1,157,842 | 10/1915 | Brandelle | 4/534 |
| 1,491,089 | 4/1924 | Erdosy | 4/530 |
| 2,095,749 | 10/1937 | Kellner | 4/534 |
| 3,375,534 | 4/1968 | Vieceli | 4/534 |
| 3,581,315 | 8/1968 | Milliner | 4/534 |
| 3,611,448 | 10/1971 | Dudley | 4/534 |
| 3,837,014 | 9/1974 | Sugiyama | 4/534 |
| 4,166,294 | 9/1979 | McGowan | 4/534 |

FOREIGN PATENT DOCUMENTS

| | | | |
|---|---|---|---|
| 2338702 | 8/1974 | Fed. Rep. of Germany | 4/533 |
| 0003345 | of 1904 | United Kingdom | 128/374 |

*Primary Examiner*—William A. Cuchlinski, Jr.
*Assistant Examiner*—John L. Beres
*Attorney, Agent, or Firm*—Henderson & Sturm

[57] ABSTRACT

A two-piece unit top for connection to the top ledge of a conventional bathtub for turning the bathtub into a steam sauna type device. Such two-piece unit traps steam rising from the hot water in the tub, thereby allowing a bather to enjoy the relaxing comforts of a steam sauna and a hot tub while using only an ordinary bathtub. A hood on one end of the two-piece cover is adjustable up and down and can be locked into the adjusted position to compensate for the different sizes of individuals using the apparatus.

10 Claims, 2 Drawing Sheets

APPARATUS FOR CONVERTING A BATHTUB INTO A SAUNA

TECHNICAL FIELD

The present invention relates generally to an apparatus for converting a bathtub into a sauna like device and more particularly to such an apparatus which has a hood on one end thereof which is adjustable in height and a vinyl cover for the remainder of the apparatus which seals to the upper ledge of a conventional bathtub.

BACKGROUND OF THE INVENTION

Numerous devices have been devised in the past for sealing the top of a bathtub while a person is inside such bathtub. The purpose of these devices is to trap the hot, moist air which rises from a hot water bath, creating a device similar to a sauna or the like without the expense involved in construction of a sauna device. U.S. Pat. Nos. 2,095,749 to Kellner, 3,375,534 to Vieceli, 3,837,014 to Sugiyama and 4,166,294 to McGowan all show devices which seal the water inside a conventional bathtub for the aforementioned purpose.

One of the problems with the prior art is that such devices are not adjustable to compensate for the varying heights and sizes of persons to use these devices. Consequently, a person who is too tall for a certain size of the prior art device would have to slouch down into the tub in order to use an improperly sized device. Conversely, a person who is too short for the design would have to somehow stretch upwardly or sit on something in the tub in order to use such prior art device.

Consequently, there is a need for an apparatus to convert a common bathtub to a sauna like device of the aforementioned type which overcomes the problems with the prior art.

DISCLOSURE OF THE INVENTION

The present invention relates generally to the use of a two-piece unit top for connection to the top ledge of a conventional bathtub for turning the bathtub into a steam sauna-type device. Such two-piece unit traps steam rising from the hot water in the tub, thereby allowing a bather to enjoy the relaxing comforts of a steam sauna and a hot tub while using only an ordinary bathtub. A hood on one end of the two-piece cover is adjustable up and down and can be locked into the adjusted position to compensate for the size of the individual using the apparatus.

An object of the present invention is to provide an improved apparatus for covering the top of a bathtub for the purpose of trapping steam from the hot water in the bathtub to allow a bather to enjoy a steam sauna and a hot tub while using an ordinary bathtub.

A further object of the present invention is to provide a device of the aforementioned type which is of two-piece construction and is adjustable in height.

A still further object of the present invention is to provide a device of the aforementioned type which can be quickly and easily attached to or removed from an ordinary bathtub.

Other objects, advantages, and novel features of the present invention will become apparent from the following detailed description of the invention when considered in conjunction with the accompanying drawings.

BEST MODE FOR CARRYING OUT THE INVENTION

Figure 1:
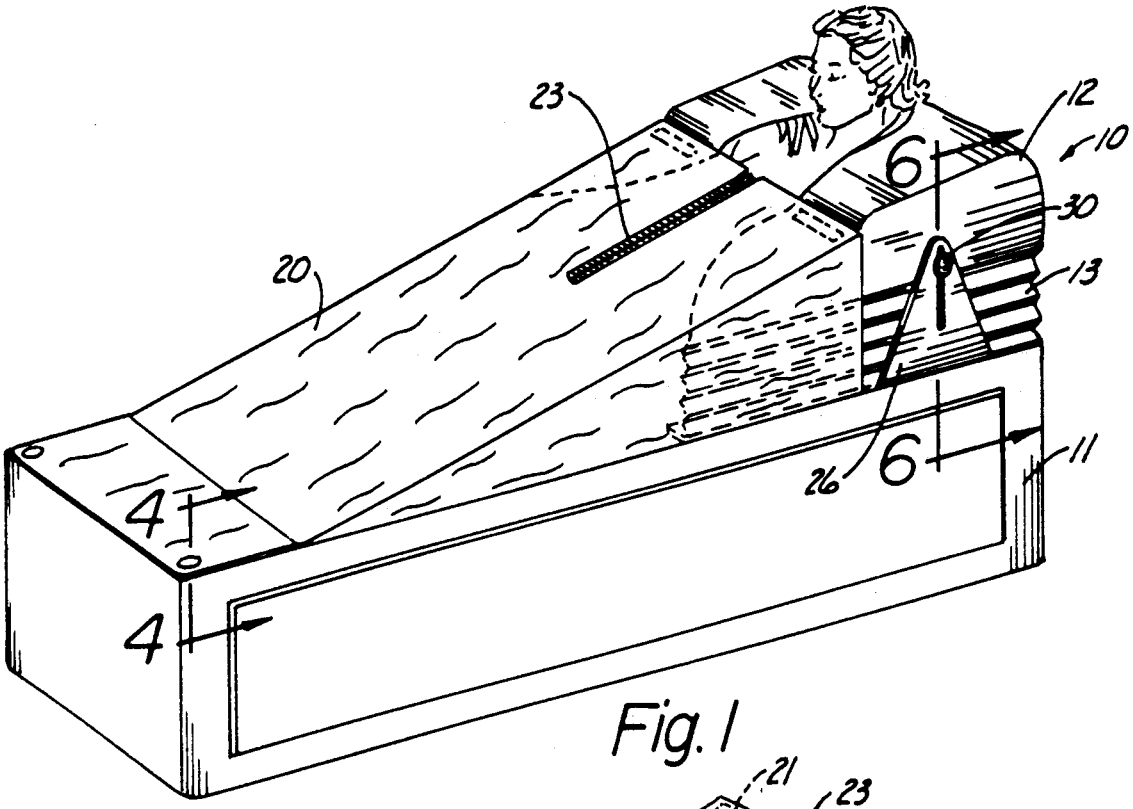
FIG. 1 is a perspective view of a preferred embodiment of the present invention shown in use attached to a bathtub with a person shown therein enjoying the comforts of both a sauna and a hot tub.

Referring now to the drawings wherein like reference numerals designate identical or corresponding parts throughout the several views, FIG. 1 shows the apparatus (10) in use by a person and connected to a bathtub (11). A hood (12) is preferably molded of a semi-rigid plastic material which will generally maintain its shape without collapsing. One example of a material which could be used to form hood (12) is polyvinyl chloride. Molded integrally with the hood (12) is an accordion-like folding adjusting mechanism (13) which extends completely around the lower portion of hood (12). This accordion shaped adjusting mechanism allows the hood (12) to be moved upwardly or downwardly unless it is locked in place.

The lower portion of the adjusting mechanism (13) has a lip (14) extending completely around the bottom thereof with a plurality of suction cups (15) attached to the bottom thereof. These suction cups can then be fastened in a conventional fashion to the upper ledge (16) of the bathtub (11).

The hood (12) has a cutout portion (17) and a headrest (18) which can be formed of the same material as the material of hood (12) or it can be of a foam-like material for greater comfort.

Figure 2:
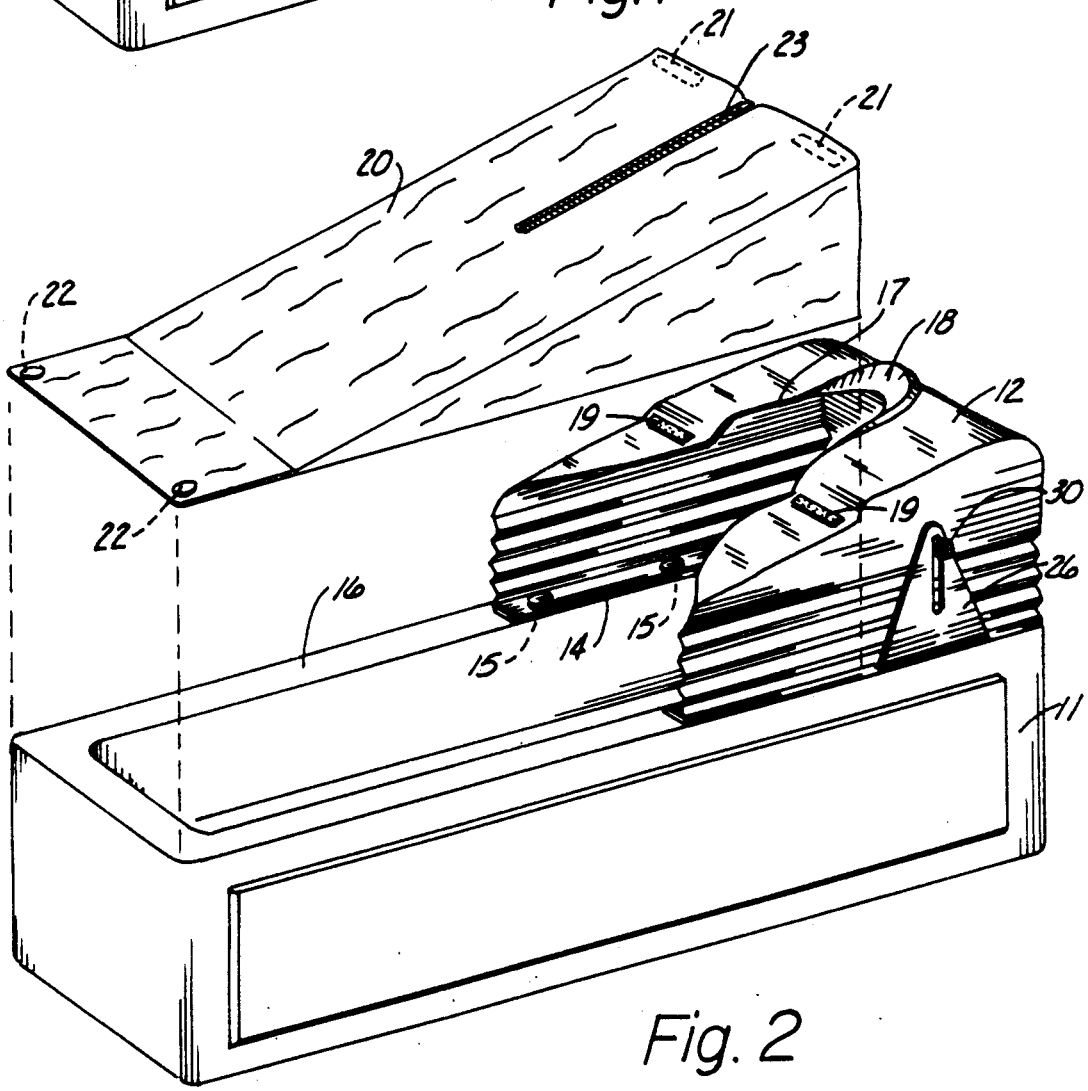
FIG. 2 is an exploded perspective view of the apparatus shown in FIG. 1.
Figure 4:
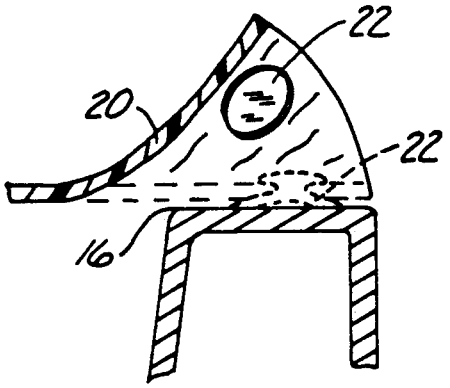
FIG. 4 is an enlarged partial cross sectional view taken along line 4—4 of FIG. 1 and showing how the suction cups seal along the upper ledge of an ordinary bathtub.
Figure 5:
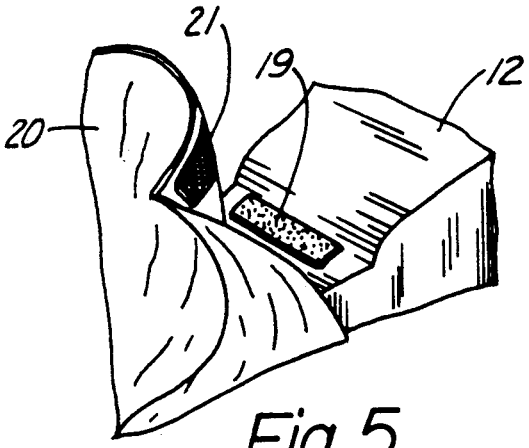
FIG. 5 is a partial perspective view showing a portion of the semi rigid plastic hood where it seals to the flexible vinyl cover and showing mating Velcro portions on each of the hood and vinyl cover.

Velcro (hook and loop fastener) strips (19) are glued to the hood (12) in the position shown in FIGS. 2 and 5. A vinyl sheet (20) can be attached to the hood (12) by mating Velcro portions (21), for example as shown in FIG. 5. The vinyl cover (20) also has a plurality of suction cups (22) attached thereto so that the vinyl cover (20) can be sealed to the top ledge (16) of the bathtub (11) for example as shown in FIGS. 1 and 4. It is to also be understood that more of the suction cups (22) can be attached to the vinyl cover (22) where it mates with the top of the tub (11) at ledge (16).

Figure 3:
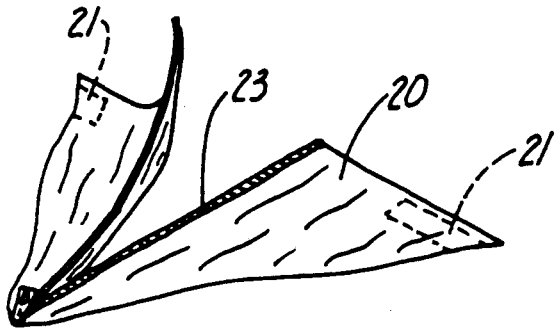
FIG. 3 is a perspective partial view of the zipper portion of the device shown in an unzipped or open position.

A zipper (23) is sewn into the vinyl cover (20) for permitting it to be opened as shown in FIG. 3.

Figure 6:
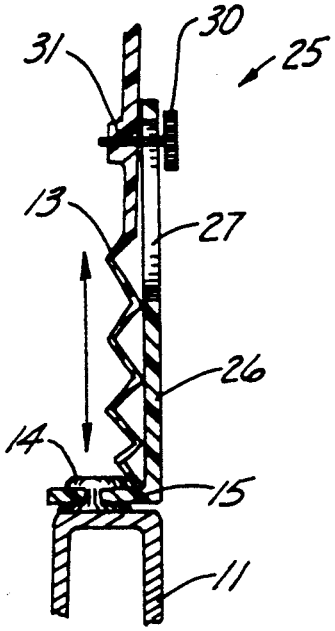
FIG. 6 is an enlarged partial cross sectional view taken along line 6—6 of FIG. 1.
Figure 7:
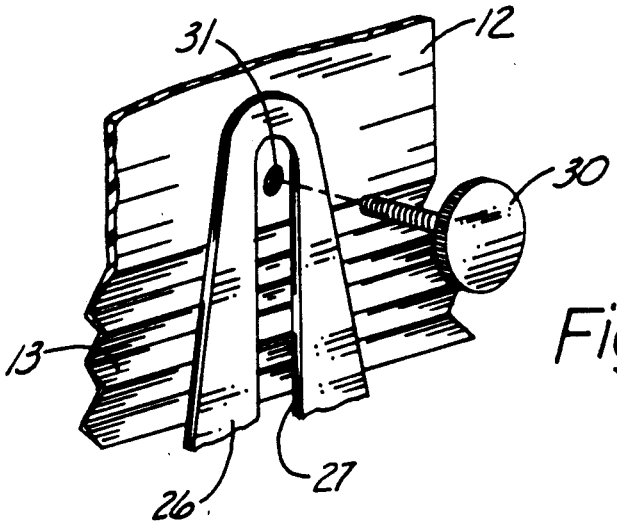
FIG. 7 is an enlarged exploded perspective view of a cutaway portion of the locking device, hood and height adjusting mechanism of the present invention.

A locking device (25) is attached to each side of the hood and height adjusting mechanism (13) for holding the hood at a desired height. Rigid brackets (26) have slots (27) therein. These brackets (27) are rigidly attached to the flange (14) of height adjusting device (13) as can readily be seen in FIG. 6. An identical adjusting mechanism (25) is also positioned on the other side of the tub from that viewed in FIG. 1. A threaded locking bolt (30) extends into a threaded opening (31) in the hood (12) as shown in FIGS. 6 and 7.

In order to use the apparatus (10) shown in FIG. 1, the hood (12) would be placed in the position shown in FIG. 2 and suction cups (15) attached to the top ledge (16) of the tub (11). The person using the apparatus (10) would then sit in the tub with the knobs (30) in the loosened position to allow the hood (12) to move up and down vertically. Once the user determines the proper height of the hood (12), the user would tighten down the knobs (30) against the bracket (26) and hood (12) to hold it securely in the chosen vertical position.

Hot water can then be allowed to run into the tub through a faucet (not shown). The vinyl sheet (20) would then be installed in the fashion shown in FIG. 2 wherein suction cups (22) are placed on the upper ledge of the tub (16) and Velcro portions (21) on the vinyl sheet (20) are placed against mating portions (19) on the hood (12). This can be done before or after a person is in the device in the position shown in FIG. 1.

The zipper (23) allows the vinyl cover (20) to be open for getting in or out of the device (10) and, similarly, the Velcro closures (19) and (21) can be easily fastened or unfastened during this process as well, depending upon the way the user desires to enter or exit the apparatus (10).

Accordingly, it will be appreciated that the preferred embodiment disclosed herein does indeed accomplish the aforementioned objects. Obviously, many modifications and variations of the present invention are possible in light of the above teachings. It is therefore to be understood that, within the scope of the appended claims, the invention may be practiced otherwise than as specifically described.

I claim:

1. Apparatus comprising:

a bathtub having container means for selectively collecting and holding water, said container means including a substantially horizontally disposed ledge surrounding said container means, said ledge including a front portion and a rear portion;

hood means extending over the front portion of said ledge for covering a person's body;

slot means for permitting a person's head to extend through said hood means while said person's body is in said container means;

means attached to said hood means and to said ledge for adjusting the height of said hood means with respect to said ledge;

a flexible waterproof sheet extending over said hood means and over the portion of said ledge which is not covered by said hood means; and means for attaching said sheet to the rear portion of said ledge.

2. The apparatus of claim 1 wherein said adjusting means comprises an accordion shaped lower wall means for selectively collapsing to lower said hood means or lengthening to raise said hood means.

3. The apparatus of claim 2 including means for selectively locking said hood means at a predetermined height.

4. The apparatus of claim 2 wherein said locking means includes a rigid bracket operatively attached at the bottom thereof to the bottom of said adjusting means, said bracket having a vertical slot disposed therein; and bolt means extending through said slot and threadably engaging said hood means for selectively holding said hood means from moving vertically with respect to said bracket in one position of said bolt means and permitting said hood means to move vertically when said bolt means is in another operative position thereof.

5. The apparatus of claim 4 wherein said locking means further includes a rigid bracket operatively attached at the bottom thereof to the bottom of said adjusting means, said second bracket having a vertical slot disposed therein; and second bolt means extending through said second slot and threadably engaging said hood means for selectively holding said hood means from moving vertically with respect to said second bracket in one position of said second bolt means and permitting one side of said hood means to move vertically when said bolt means is in another operative position thereof.

6. The apparatus of claim 1 including a zipper means in said sheet for selectively permitting a portion of said sheet adjacent to said slot means to selectively open or close.

7. The apparatus of claim 1 including head rest means attached to said hood means adjacent a front portion of said slot means for permitting a user to rest one's head or neck thereon.

8. The apparatus of claim 1 including hook and loop fastener means for selectively holding a front portion of said sheet to a rear portion of said hood means.

9. The apparatus of claim 1 including suction cups means attached to said height adjusting means for attaching said adjusting means to said ledge.

10. The apparatus of claim 1 wherein said attaching means includes suction cup means attached to said sheet for holding the sheet to said rear portion of said ledge.

* * * * *